US007575474B1

(12) United States Patent
Dodson et al.

(10) Patent No.: US 7,575,474 B1
(45) Date of Patent: Aug. 18, 2009

(54) SURFACE MOUNT RIGHT ANGLE CONNECTOR INCLUDING STRAIN RELIEF AND ASSOCIATED METHODS

(75) Inventors: James Bradley Dodson, Palm Bay, FL (US); Norman Rivers, Satellite Beach, FL (US); George Albert Harrison, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 12/136,295

(22) Filed: Jun. 10, 2008

(51) Int. Cl.
*H01R 9/05* (2006.01)

(52) U.S. Cl. ..... 439/581

(58) Field of Classification Search ..... 439/581, 439/63, 79, 83, 607–610
See application file for complete search history.

(56) References Cited

U.S. PATENT DOCUMENTS

| | | | | | |
|---|---|---|---|---|---|
| 3,179,912 | A * | 4/1965 | Huber et al. | 439/581 |
| 3,573,687 | A * | 4/1971 | Watanabe | 439/581 |
| 3,594,687 | A * | 7/1971 | Alderfer | 439/581 |
| 4,603,926 | A * | 8/1986 | Nesbit et al. | 439/63 |
| 4,645,288 | A * | 2/1987 | Stursa | 439/581 |
| 4,669,805 | A | 6/1987 | Kosugi et al. | 439/581 |
| 5,088,937 | A * | 2/1992 | Gabany | 439/581 |
| 5,174,775 | A * | 12/1992 | Birch | 439/188 |
| 5,180,315 | A * | 1/1993 | Nagashima | 439/581 |
| 5,215,470 | A * | 6/1993 | Henry et al. | 439/63 |
| 5,326,280 | A * | 7/1994 | Briones et al. | 439/581 |
| 5,405,267 | A | 4/1995 | Koegel et al. | 439/79 |
| 5,532,659 | A | 7/1996 | Dodart | 333/260 |
| 5,618,205 | A | 4/1997 | Riddle et al. | 439/581 |
| 5,879,166 | A * | 3/1999 | Wang | 439/63 |
| 5,897,384 | A * | 4/1999 | Hosler, Sr. | 439/63 |
| 6,390,825 | B1 * | 5/2002 | Handley et al. | 439/63 |
| 6,774,742 | B1 | 8/2004 | Fleury et al. | 333/33 |
| 6,842,084 | B2 | 1/2005 | Herstein | 333/33 |
| 2004/0038587 | A1 * | 2/2004 | Yeung et al. | 439/581 |
| 2004/0119557 | A1 | 6/2004 | Barnes et al. | 333/33 |
| 2005/0250383 | A1 * | 11/2005 | Bourgeas et al. | 439/581 |
| 2007/0111596 | A1 * | 5/2007 | Weidner et al. | 439/581 |
| 2009/0117779 | A1 * | 5/2009 | Zhang | 439/581 |

OTHER PUBLICATIONS

"GPPO® Interconnect Series Product Information", 10 pages, 2003-2004 Corning Gilbert Inc., available at www.corning.com/corning-gilbert.

(Continued)

*Primary Examiner*—T C Patel
*Assistant Examiner*—Harshad C Patel
(74) *Attorney, Agent, or Firm*—Allen, Dyer, Doppelt, Milbrath & Gilchrist, P.A.

(57) ABSTRACT

An electronic device includes a printed circuit board (PCB) including a planar surface conductor, e.g. such as a microstrip transmission line or coplanar transmission waveguide. A surface mount connector portion is mounted to the PCB and includes an electrically conductive header having a cylindrical bore extending therethrough and aligned normal to the PCB, the electrically conductive header also having a radially extending main recess in a bottom end thereof in communication with the cylindrical bore. An electrically conductive pin extends through the main recess and has a first end coupled to the planar surface conductor, a second end within the cylindrical bore and a bend therebetween. A dielectric is in the main recess between the pin and adjacent portions of the electrically conductive header, and an interconnect is within the cylindrical bore and includes a center conductive channel to receive the second end of the pin.

24 Claims, 4 Drawing Sheets

OTHER PUBLICATIONS

"Guidelines for Installing Hermetic GPO® and GPPO® Connectors", 4 pages, Sep. 2004, Corning Gilbert Inc., available at www.corning.com/corninggilbert.

"Commercial Right Angle PCB Mount Jack", 2 pages, 2001-2008 Amphenol® Connex, available at www.amphenolconnex.com/SearchResults.asp?ProductID=242.

* cited by examiner

SURFACE MOUNT RIGHT ANGLE CONNECTOR INCLUDING STRAIN RELIEF AND ASSOCIATED METHODS

GOVERNMENT LICENSE RIGHTS

U.S. Government has a paid-up license in this invention and the right in limited circumstances to require the patent owner to license others on reasonable terms.

FIELD OF THE INVENTION

The present invention relates to the field of radio frequency (RF) and microwave circuits and systems, and, more particularly, to surface mount connectors for use in RF and microwave circuits and systems, and related methods.

BACKGROUND OF THE INVENTION

"Printed circuit boards" (PCBs) or "printed wiring boards" (PWBs) are frequently interconnected with one another using coaxial cables in high frequency devices, circuits and subsystems, such as those operating at radio frequency (RF) and microwave frequency ranges. Coaxial connectors at an interface between a PCB and the coaxial cable allow a PCB to be connected and disconnected during assembly and/or testing, as well as for maintenance and replacement purposes once the PCB has been deployed. A variety of classes or series of standard and semi-custom coaxial connectors are readily available and in widespread use including, for example, SMA, SMB, SMC, SSMA, 3.5-mm, 2.4-mm and 1.85-mm connectors. Each of the various coaxial connector series is available in a variety of styles, each style being adapted to a particular application and/or circuit-mounting configuration.

Coaxial connectors provide an inner or signal conductor coaxially disposed within an outer conductor both having precisely controlled radii having a common axis, with the dielectric material disposed therebetween. Certain coaxial connectors are mountable to circuit boards, with the signal conductor electrically connected to a signal circuit of the board and the outer conductor electrically connected to a ground path on the board, and the electrical connections are commonly achieved by soldering. One such connector is disclosed in U.S. Pat. No. 4,650,271.

A known technique of accomplishing this is to end launch a right angle coaxial connector onto a planar surface conductor, e.g. a microstrip, along the substrate edge. In U.S. Pat. No. 5,405,267, a plurality of similar board-mountable coaxial connectors is secured to a mounting bracket that is affixed to a circuit board along an edge thereof, with each coaxial connector extending through a panel cutout at an input/output port of an electronic apparatus. Disadvantages of this approach include the relatively large space and volume requirements, and the requirement that the transition be made at the edge of the substrate.

Among the coaxial connector styles used in conjunction with high frequency PCBs are surface-mountable styles often referred to as "surface mount" (SMT) connectors. One SMT edge launch connector has a female-type SMA coaxial connector interface on one end and a center pin extending from the other end. The center pin is typically surrounded by a dielectric material, such as TEFLON, and forms a coaxial transmission structure having a characteristic impedance with the metal body of the SMT edge launch connector. Ledges extend away from the metal body to support the SMT edge launch connector in a cutout in a printed circuit board during assembly (e.g. soldering).

Corning Gilbert Inc., of Glendale, Ariz., produce a Gilbert Puny Push On (GPPO) edge mount, catalog series number B010-L, and a GPPO right angle to printed circuit board coupling, catalog series number B009-P, both of which are designed to couple a PC transmission line to a coaxial transmission line. In both cases, the component is connected to the PC transmission line, and the combined component and transmission line may then be "pushed-on" to the coaxial transmission line so that the two lines are interconnected. These connectors provide little or no strain relief and typically require RF tuning on the substrate.

There is a need in many RE systems to provide a surface mountable orthogonal transition from a PCB planar surface conductor, e.g. a microstrip transmission line or coplanar transmission waveguide, to a coaxial transmission line with sufficient strain relief and without RF tuning.

SUMMARY OF THE INVENTION

In view of the foregoing background, it is therefore an object of the present invention to provide a surface mount right-angle or orthogonal transition from a cable to a PCB planar surface conductor, e.g. a microstrip transmission line or coplanar transmission waveguide, with sufficient strain relief.

This and other objects, features, and advantages in accordance with the present invention are provided by an electronic device including a printed circuit board (PCB) comprising a dielectric layer and an electrically conductive layer thereon defining a planar surface conductor, such as a microstrip transmission line or coplanar transmission waveguide. A surface mount connector portion is mounted to the PCB and includes an electrically conductive header having a first cylindrical bore extending therethrough and aligned normal to the PCB, the electrically conductive header also having a radially extending main recess in a bottom end thereof in communication with the cylindrical bore. An electrically conductive pin extends through the radially extending main recess and has a first end coupled to the planar surface conductor, a second end within the cylindrical bore and a bend therebetween. A dielectric material is in the main recess between the electrically conductive pin and adjacent portions of the electrically conductive header, and an interconnect is carried by the electrically conductive header and includes a center conductive channel to receive the second end of the electrically conductive pin.

The surface mount connector portion may further comprise a cavity between the cylindrical bore and the radially extending main recess and surrounding the bend of the electrically conductive pin, e.g. to define a controlled impedance. Also, a coaxial cable end and a cable connector portion coupled thereto may be coupled to the surface mount connector portion via the interconnect.

The electrically conductive header may include a second cylindrical bore above and concentric to the first cylindrical bore; and, the interconnect, such as a replaceable sub-sub-miniature A (SSMA) connector, may include a first threaded end for securing into the second cylindrical bore of the electrically conductive header, and a second threaded end for securing the cable connector portion thereon. An underside of the electrically conductive pin is preferably held against the dielectric layer of the PCB by the surface mount connectior portion, and the first end thereof may be soldered to the planar surface conductor.

One or more fasteners, such as a screw or adhesive, for example, may secure the electrically conductive header to the PCB to, in combination with the interconnect, provide strain relief for the surface mount connector. The radially extending recess may have an arcuate cross-sectional shape. If needed to ensure adequate header compression or contact with the PCB, the electrically conductive header may further comprise a pair of radially extending secondary recesses, and associated electrically conductive bodies therein, on the bottom portion on opposite sides of the main radially extending recess. Also, the PCB may include ground vias within the dielectric layer, and the electrically conductive bodies within the radially extending secondary recesses contact the ground vias.

A method aspect is directed to making an electronic device including providing a printed circuit board (PCB) having a dielectric layer and an electrically conductive layer thereon defining a planar surface conductor. The method includes mounting a surface mount connector portion to the PCB, including forming an electrically conductive header with a first cylindrical bore extending therethrough and aligned normal to the PCB, and with a radially extending main recess in a bottom end thereof in communication with the first cylindrical bore. An electrically conductive pin is extended through the radially extending main recess with a first end coupled to the planar surface conductor, a second end within the cylindrical bore and a bend therebetween. The method further includes providing the main recess with a dielectric material between the electrically conductive pin and adjacent portions of the electrically conductive header, and providing an interconnect carried by the header and including a center conductive channel to receive the second end of the electrically conductive pin.

Forming the electrically conductive header may further comprise providing a cavity, e.g. for controlled impedance, between the cylindrical bore and the radially extending main recess to surround the bend of the electrically conductive pin. Also, a coaxial cable end and a cable connector portion coupled thereto may be coupled to the surface mount connector portion via the interconnect. Providing the interconnect, such as a replaceable sub-subminiature A (SSMA) connector, may comprise threading a first threaded end thereof into a second cylindrical bore of the electrically conductive header, and securing the cable connector portion on a second threaded end of the interconnect.

Mounting the surface mount connector portion may include holding an underside of the electrically conductive pin against the dielectric layer of the PCB via the surface mount connector portion. Furthermore, the method may include securing the electrically conductive header to the PCB with at least one fastener, such as a screw or adhesive, to, in combination with the interconnect, provide strain relief for the surface mount connector.

Forming the electrically conductive header may include forming the radially extending recess with an arcuate cross-sectional shape. Also, forming the electrically conductive header may further include forming a pair of radially extending secondary recesses on the bottom portion on opposite sides of the main radially extending recess. The PCB may include ground vias within the dielectric layer, and electrically conductive bodies may be provided within the radially extending secondary recesses to contact the ground vias.

Thus, with the present approach, a surface mount connector may be provided for a PCB of a high frequency or broadband (DC—20 GHz) electronic device that includes a right-angle pin launch onto the PCB planar surface conductor with sufficient cable strain relief. The radially extending main recess in the header, the dielectric material and the adjacent PCB define part of a coaxial structure for the first end of the conductive pin that is coupled to the microstrip transmission line of the PCB planar surface conductor. No tuning is needed, and the amount of overlap between the coaxial mode and the microstrip mode provides a soft transition that may increase usable bandwidth.

DETAILED DESCRIPTION OF THE PREFERRED EMBODIMENTS

Figure 2:
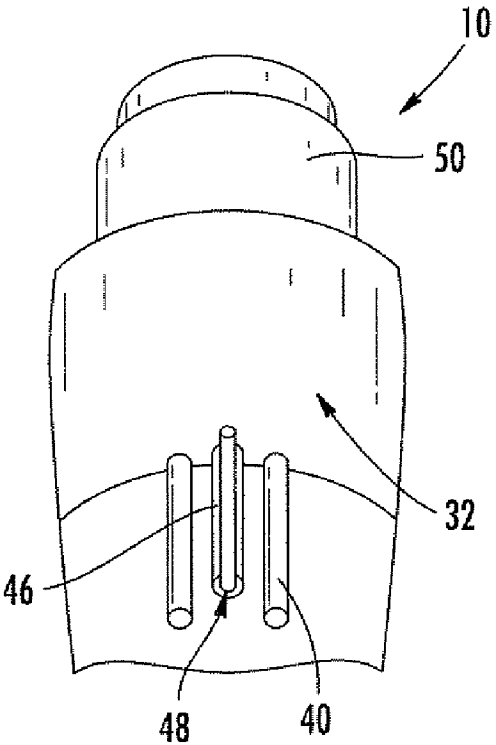
FIG. 2 is a perspective bottom view of the electronic device of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-5, an electronic device 10, e.g. for operation in the RF and microwave frequency ranges, that includes a surface mount right-angle or orthogonal transition from a cable 12 to a planar surface conductor 22 with sufficient strain relief will now be described. The electronic device 10 includes a printed circuit board (PCB) having a dielectric layer 21 and an electrically conductive layer thereon defining a PCB planar surface conductor 22, e.g. such as a microstrip transmission line or coplanar transmission waveguide.

A surface mount connector portion 30 is mounted to the PCB 20 and includes an electrically conductive header 32 having a cylindrical bore 34 extending therethrough and aligned normal to the PCB. The electrically conductive header 32 also has a radially extending main recess 36 in a bottom end thereof in communication with the cylindrical bore 34. The radially extending main recess 36 may have an arcuate cross-sectional shape. An electrically conductive pin 38 extends through the radially extending main recess 36 and has a first end 40 coupled to the planar surface conductor 22, a second end 42 within the cylindrical bore 34 and a bend 44 therebetween. The diametric ratio of the cylindrical bore 34 and the electrically conductive pin 38 define a controlled impedance.

A dielectric material 46, such as air or a TEFLON liner, is in the main recess 36 between the electrically conductive pin 38 and adjacent portions of the electrically conductive header 32. An underside of the electrically conductive pin 38 is preferably held against the dielectric layer of the PCB by the radially extending main recess 36 and dielectric liner 46. The radially extending main recess 36, the dielectric liner 46 and the adjacent PCB dielectric layer 21 may be thought of as defining part of a coaxial structure for the first end 40 of the conductive pin 38 that is coupled to the microstrip transmission line 22 of the PCB 20.

Figure 1:
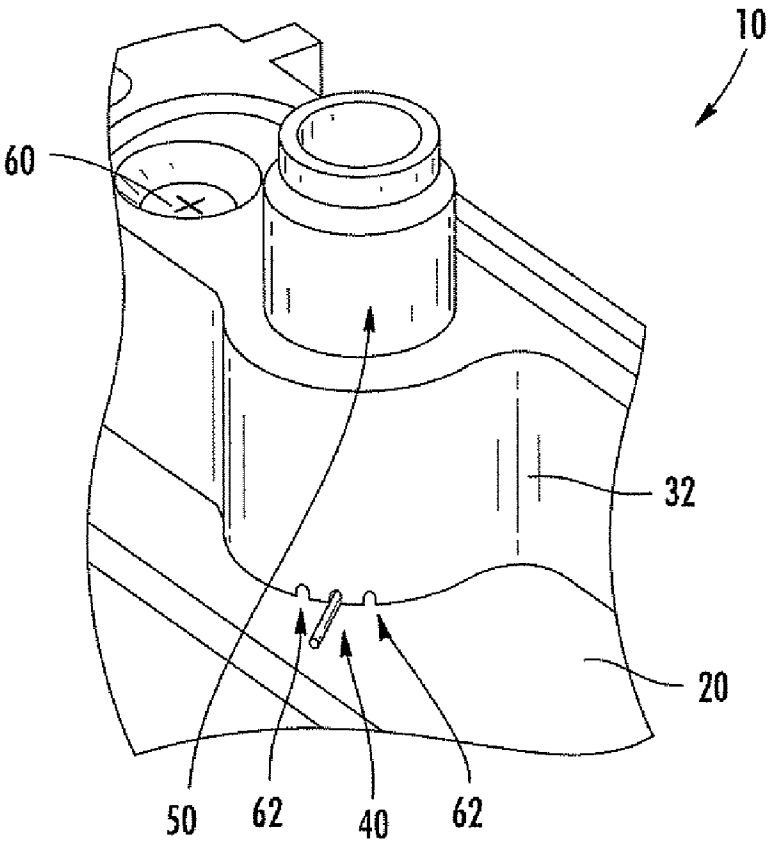
FIG. 1 is a perspective view of an electronic device including a surface mount connector and PCB according to the present invention.
Figure 3:
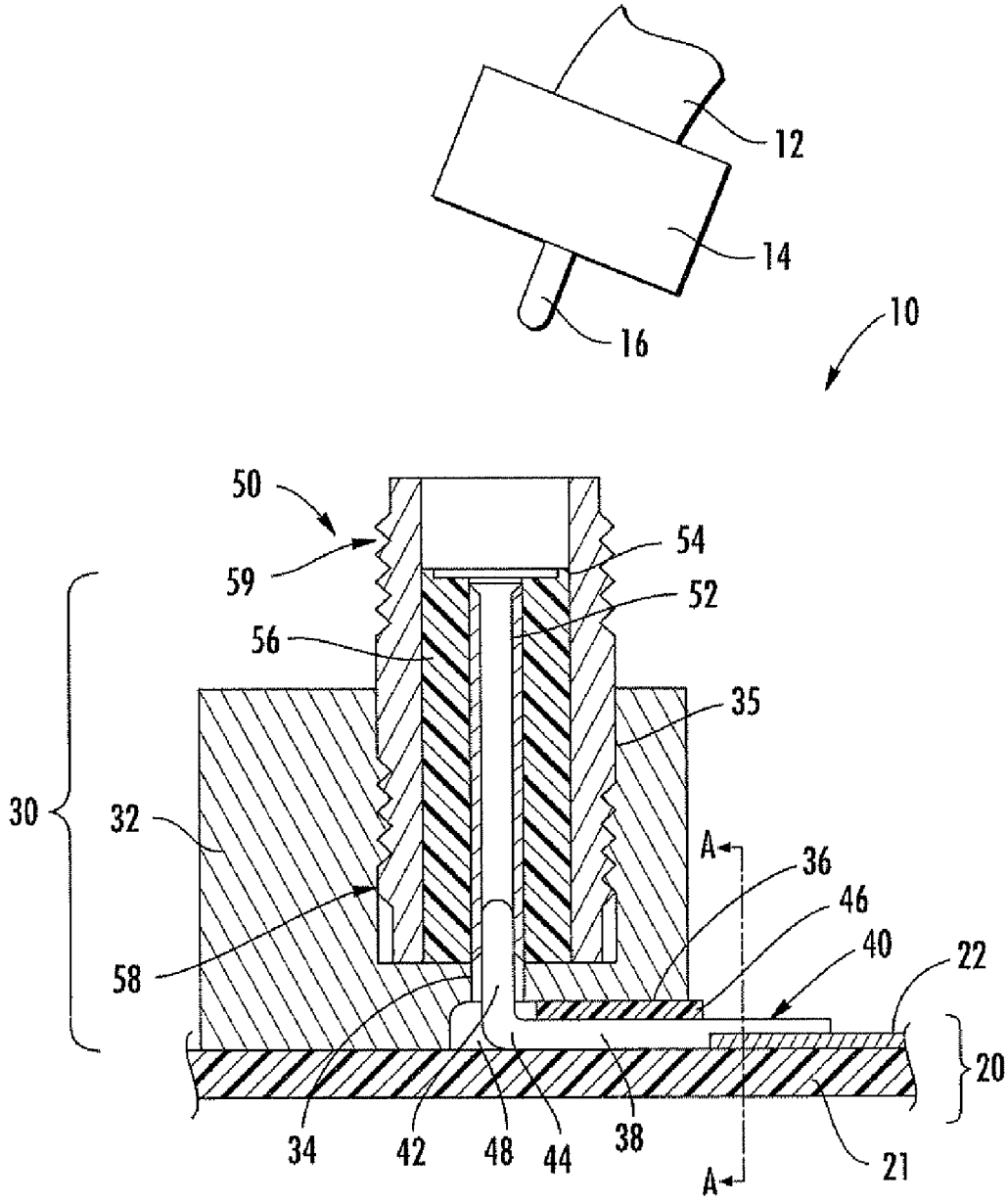
FIG. 3 is a partial cross-sectional view of the electronic device of FIG. 1.

As illustrated in the embodiment of FIGS. 1-3, the header 32 may include a second cylindrical bore 35 above and concentric with the first cylindrical bore 34. The second cylindrical bore 35 has a larger diameter than the first cylindrical bore 34 for carrying or receiving an interconnect 50.

The interconnect 50, such as an externally threaded female-type SSMA interconnect, for example, is within the cylindrical bore 35 and includes a center conductive channel 52 to receive the second end 42 of the electrically conductive pin 38. An example of such an interconnect is the 120-05SF provided by Southwest Microwave of Tempe, Ariz. As would be appreciated by those skilled in the art, such an interconnect may include an outer electrically conductive shell 54 supporting a dielectric layer 56 and the center conductor 52 therein. Furthermore, other types of interconnects with corresponding support structure in the header 32 may be used.

The surface mount connector portion 30 also illustratively has a cavity 48 between the cylindrical bore 34 and the radially extending main recess 36 and surrounding the bend 44 of the electrically conductive pin 38. The cavity 48 or air dielectric may aid in the impedance matching between the electrically conductive pin 38 and the planar surface conductor 22.

A coaxial cable 12 and a cable connector portion 14 coupled to an end thereof may be coupled to the surface mount connector portion 30 via the interconnect 50. The cable connector portion 14 may be an internally threaded male-type SSMA connector to removably fasten the inner conductor 16 of the coaxial cable 12 to the center conductor 52 of the interconnect 50. Illustratively, the interconnect 50, such as a replaceable SSMA connector, may include a first threaded end 58 for securing into corresponding threads of the cylindrical bore 35 of the electrically conductive header 32. A second threaded end 59 secures the cable connector portion 14 thereon.

One or more fasteners, such as a screw 60 or an adhesive, may secure the electrically conductive header 32 to the PCB 20 to, in combination with the interconnect 50, provide strain relief for the surface mount connector 30. The fastener should ensure adequate ground contact between the header 32 and the PCB 20. As perhaps best shown in FIGS. 4 and 5, the electrically conductive header 32 may optionally comprise a pair of radially extending secondary recesses 62 on the bottom portion on opposite sides of the main radially extending recess 36. Also, the PCB 20 may include ground vias 64 within the dielectric layer 21. In one embodiment, electrically conductive bodies 66, such as conductive springs, may be provided within the radially extending secondary recesses 62 to contact the ground vias 64 and provide a reliable ground reference for the surface mount connector portion 30, e.g. if header compression is an issue.

Figure 5:
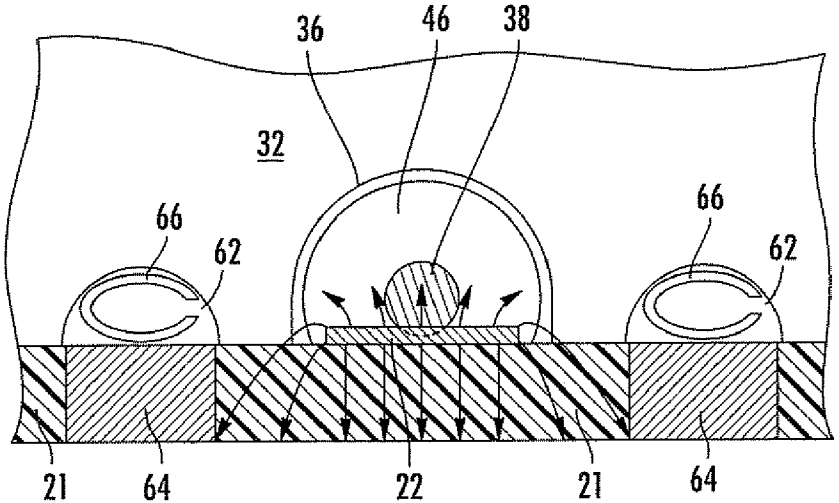
FIGS. 4 and 5 are cross-sectional views of a portion of the electronic device taken along the line A-A of FIG. 3 and respectively illustrating field lines for each mode.
Figure 4:
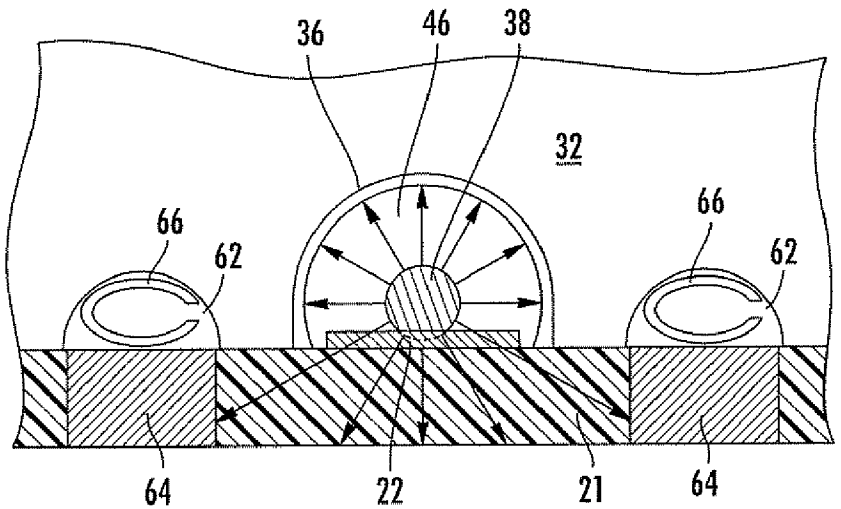

The arrows in FIG. 4 illustrates the field lines from the conductive pin 38 to ground when the electronic device 10 is operating in the coaxial mode. The arrows in FIG. 5 illustrate the field lines from the planar surface conductor 22 when the electronic device 10 is operating in the planar surface conductor mode. As is known to those skilled in the art, the most efficient way to couple energy into a desired mode is to launch the energy so that it is close to or already in that mode. From FIG. 4 and FIG. 5, it is clear that there is similarity between these electrical field lines and the mode transition between them causes minimal mismatch.

Figure 6:
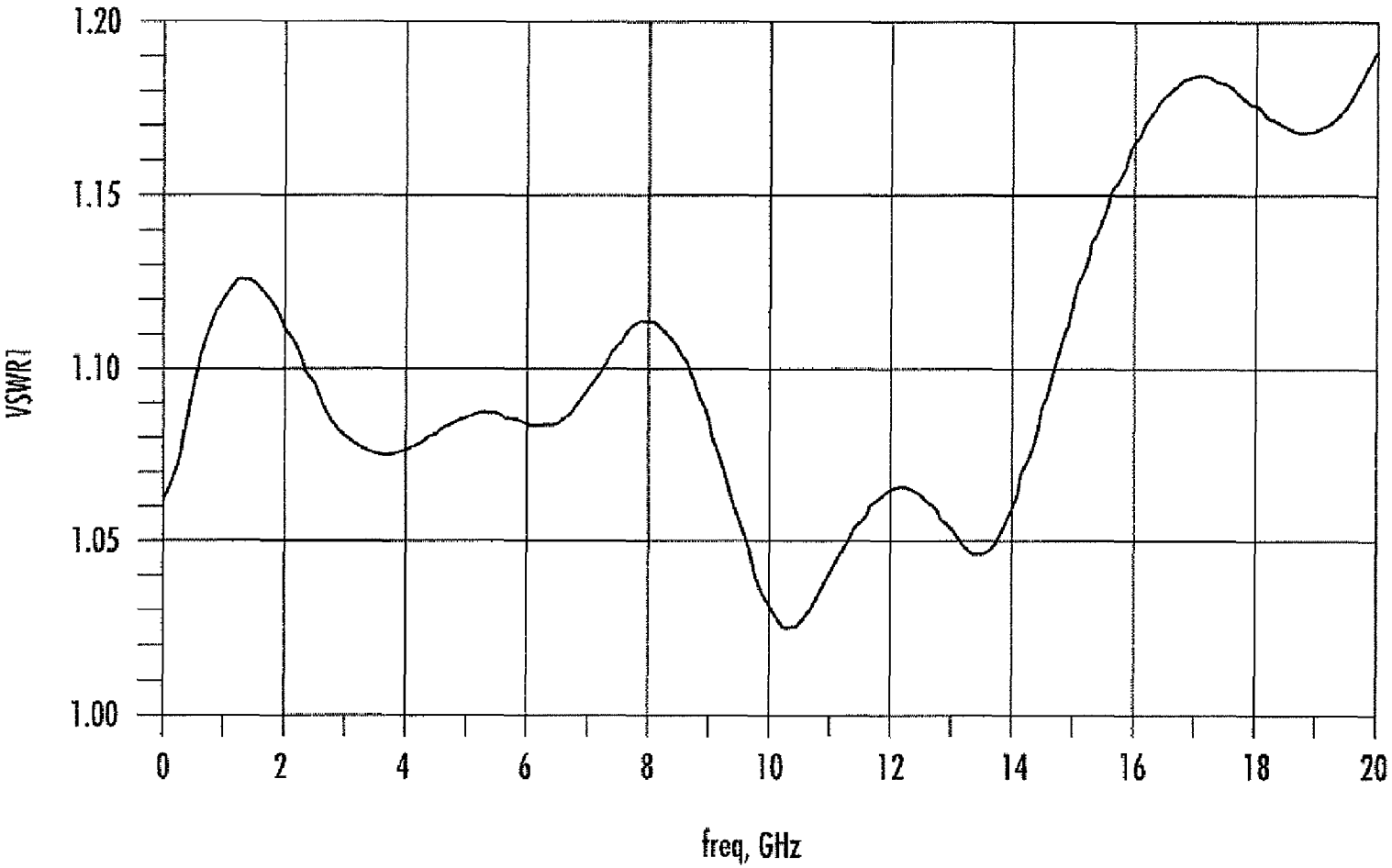
FIG. 6 is a graph illustrating the Voltage Standing Wave Ratio (VSWR) versus frequency for an example of the surface mount connection in the electronic device of FIG. 1.

FIG. 6 is a graph illustrating the measured Voltage Standing Wave Ratio (VSWR) versus frequency for an example of the surface mount connection in the electronic device 10 of FIGS. 1-5. Conventional right-angle connectors using similarly sized conductive pins may be rated at <1.2 VSWR up to 20 GHz, but the surface mount connection provided by the present approach meets this specification without any additional tuning devices.

Thus, with the present approach, a surface mount connection may be provided for a PCB 20 of a high frequency or broadband (DC—20 GHz) electronic device 10 that includes a right-angle pin launch onto the planar surface conductor 22 with sufficient cable strain relief. The radially extending main recess 36 in the header 32, the dielectric liner 46 and the adjacent PCB dielectric 21 define part of a coaxial structure for the first end 40 of the conductive pin 38 that is coupled to the planar surface conductor 22 of the PCB 20. No additional tuning is needed, and the amount of overlap between the coaxial mode and the planar surface conductor mode provides a soft transition that may increase usable bandwidth.

A method aspect is directed to making an electronic device 10 including providing the PCB 20 having the dielectric layer 21 and an electrically conductive layer thereon defining a planar surface conductor 22. The method includes mounting a surface mount connector portion 30 to the PCB 20, including forming an electrically conductive header 32 with a cylindrical bore 34 extending therethrough and aligned normal to the PCB, and with a radially extending main recess 36 in a bottom end thereof in communication with the cylindrical bore.

An electrically conductive pin 38 is extended through the radially extending main recess 36 with a first end 40 coupled to the planar surface conductor 22, a second end 42 within the cylindrical bore 34 and a bend 44 therebetween. As would be appreciated by those skilled in the art, the recited steps do not imply a specific sequence and indeed many variations are possible. A second cylindrical bore 35 is above and concentric with the first cylindrical bore 34. The second cylindrical bore 35 has a larger diameter than the first cylindrical bore 34 for carrying or receiving an interconnect 50.

The method further includes providing the main recess 36 with a dielectric 46 (e.g. a TEFLON liner or air) between the electrically conductive pin 38 and adjacent portions of the electrically conductive header 32, and providing an interconnect 50 within the second cylindrical bore 35 and including a center conductive channel 52 to receive the second end 42 of the electrically conductive pin 38.

Forming the electrically conductive header 32 may further comprise providing a cavity 48 between the cylindrical bore 34 and the radially extending main recess 36 to surround the bend 44 of the electrically conductive pin 38. Also, a coaxial cable end 12 and a cable connector portion 14 coupled thereto may be coupled to the surface mount connector portion 30 via the interconnect 50. Providing the interconnect 50, such as a replaceable sub-subminiature A (SSMA) connector, may comprise threading a first threaded end 58 thereof into the second cylindrical bore 35 of the electrically conductive header 32, and securing the cable connector portion 14 on a second threaded end 59 of the interconnect 50.

Mounting the surface mount connector portion 30 may include solder attachment of the electrically conductive pin 38 and holding an underside of the electrically conductive pin 38 against the dielectric layer 21 of the PCB 20 via the radially extending main recess 36 and dielectric 46. Furthermore, the method may include securing the electrically conductive header 32 to the PCB 20 with at least one fastener, such as screw 60 or an adhesive or epoxy, to, in combination with the interconnect 50, provide strain relief for the surface mount connector 30.

Forming the electrically conductive header 32 may include forming the radially extending recess 36 with an arcuate cross-sectional shape. Also, forming the electrically conductive header 32 may further include forming a pair of radially extending secondary recesses 62 on the bottom portion on opposite sides of the main radially extending recess 36. The PCB 20 may include ground vias 64 within the dielectric layer 21, and electrically conductive bodies 66 may be provided within the radially extending secondary recesses to contact the ground vias.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An electronic device comprising:

a printed circuit board (PCB) comprising a dielectric layer and an electrically conductive layer thereon defining a planar surface conductor; and a surface mount connector portion mounted to the PCB and comprising an electrically conductive header having a cylindrical bore extending therethrough and aligned normal to the PCB, the electrically conductive header also having a radially extending main recess in a bottom end thereof in communication with the cylindrical bore, an electrically conductive pin extending through the radially extending main recess and having a first end coupled to the planar surface conductor, a second end within the cylindrical bore and a bend therebetween, a dielectric material in the main recess between the electrically conductive pin and adjacent portions of the electrically conductive header, and an interconnect carried by the electrically conductive header and including a center conductive channel to receive the second end of the electrically conductive pin.

2. The electronic device according to claim 1 wherein the surface mount connector portion further comprises a cavity between the cylindrical bore and the radially extending main recess and surrounding the bend of the electrically conductive pin.

3. The electronic device according to claim 2 further comprising a coaxial cable end and a cable connector portion coupled thereto; and wherein the cable connector portion is coupled to the surface mount connector portion via the interconnect.

4. The electronic device according to claim 3 wherein the interconnect comprises a first threaded end for securing into the cylindrical bore of the electrically conductive header, and a second threaded end for securing the cable connector portion thereon.

5. The electronic device according to claim 4 wherein the interconnect comprises a replaceable sub-subminiature A (SSMA) type connector.

6. The electronic device according to claim 1 wherein an underside of the electrically conductive pin is held against the dielectric layer of the PCB by the radially extending main recess and dielectric liner.

7. The electronic device according to claim 1 further comprising at least one fastener for securing the electrically conductive header to the PCB to, in combination with the interconnect, provide strain relief for the surface mount connector.

8. The electronic device according to claim 1 wherein the radially extending recess has an arcuate cross-sectional shape.

9. The electronic device according to claim 1 wherein the electrically conductive header further comprises a pair of radially extending secondary recesses on the bottom portion on opposite sides of the main radially extending recess; and wherein the PCB includes ground vias within the dielectric layer; and further comprising electrically conductive bodies within the radially extending secondary recesses and contacting the ground vias.

10. An electronic device comprising:

a printed circuit board (PCB) comprising a dielectric layer and an electrically conductive layer thereon defining a planar surface conductor;

a coaxial cable end and a cable connector portion coupled thereto; and a surface mount connector portion mounted to the PCB and comprising an electrically conductive header having a cylindrical bore extending therethrough and aligned normal to the PCB, the electrically conductive header also having a radially extending main recess in a bottom end thereof in communication with the cylindrical bore, and a cavity between the cylindrical bore and the radially extending main recess, an electrically conductive pin extending through the radially extending main recess and having a first end coupled to the planar surface conductor, a second end within the cylindrical bore and a bend therebetween and within the cavity, a dielectric material in the main recess between the electrically conductive pin and adjacent portions of the electrically conductive header, and an interconnect including a center conductive channel to receive the second end of the electrically conductive pin, the interconnect comprising a first threaded end secured into the electrically conductive header, and a second threaded end to secure the cable connector portion thereon.

11. The electronic device according to claim 10 wherein the interconnect comprises a sub-subminiature A (SSMA) type connector.

12. The electronic device according to claim 10 wherein an underside of the electrically conductive pin is held against the dielectric layer of the PCB by the radially extending main recess and the dielectric liner.

13. The electronic device according to claim 10 further comprising at least one fastener for securing the electrically conductive header to the PCB to, in combination with the interconnect, provide strain relief for the surface mount connector.

14. The electronic device according to claim 10 wherein the radially extending recess has an arcuate cross-sectional shape.

15. The electronic device according to claim 10 wherein the electrically conductive header further comprises a pair of radially extending secondary recesses on the bottom portion on opposite sides of the main radially extending recess; and wherein the PCB includes ground vias within the dielectric layer; and further comprising electrically conductive bodies within the radially extending secondary recesses and contacting the ground vias.

16. A method of making an electronic device comprising:

providing a printed circuit board (PCB) comprising a dielectric layer and an electrically conductive layer thereon defining a planar surface conductor; and mounting a surface mount connector portion to the PCB and comprising forming an electrically conductive header with a cylindrical bore extending therethrough and aligned normal to the PCB, and with a radially extending main recess in a bottom end thereof in communication with the cylindrical bore, extending an electrically conductive pin through the radially extending main recess with a first end coupled to the planar surface conductor, a second end within the cylindrical bore and a bend therebetween, lining the main recess with a dielectric liner between the electrically conductive pin and adjacent portions of the electrically conductive header, and providing an interconnect carried by the electrically conductive header and including a center conductive channel to receive the second end of the electrically conductive pin.

17. The method according to claim 16 wherein forming the electrically conductive header further comprises providing a cavity between the cylindrical bore and the radially extending main recess to surround the bend of the electrically conductive pin.

18. The method according to claim 17 further comprising providing a coaxial cable end and a cable connector portion coupled thereto; and coupling the cable connector portion to the surface mount connector portion via the interconnect.

19. The method according to claim 18 wherein providing the interconnect comprises threading a first threaded end thereof into the cylindrical bore of the electrically conductive header, and securing the cable connector portion on a second threaded end of the interconnect.

20. The method according to claim 19 wherein providing the interconnect comprises providing a replaceable sub-sub-miniature A (SSMA) type connector.

21. The method according to claim 16 wherein mounting the surface mount connector includes holding an underside of the electrically conductive pin against the dielectric layer of the PCB via the radially extending main recess and dielectric material.

22. The method according to claim 16 further comprising securing the electrically conductive header to the PCB with at least one fastener to, in combination with the interconnect, provide strain relief for the surface mount connector.

23. The electronic device according to claim 16 wherein forming the electrically conductive header includes forming the radially extending recess with an arcuate cross-sectional shape.

24. The method according to claim 16 wherein forming the electrically conductive header further comprises forming a pair of radially extending secondary recesses on the bottom portion on opposite sides of the main radially extending recess; and wherein providing the PCB includes forming ground vias within the dielectric layer; and further comprising providing electrically conductive bodies within the radially extending secondary recesses and contacting the ground vias.

* * * * *